United States Patent [19]

Watkins

[11] Patent Number: 4,481,965

[45] Date of Patent: Nov. 13, 1984

[54] COMPACT FOLDING WALKING AID

[76] Inventor: Mervyn M. Watkins, 30241 Via Borica, Rancho Palos Verdes, Calif. 90274

[21] Appl. No.: 431,042

[22] Filed: Sep. 30, 1982

[51] Int. Cl.[3] ..... A61H 3/00

[52] U.S. Cl. ..... 135/67; 135/74

[58] Field of Search ..... 135/67, 74; 272/70.3, 272/70.4; 297/5, 6; 248/155, 155.1, 155.2, 155.3, 155.4, 155.5; D3/7, 8, 9; 280/87.02 R, 87.02 W, 87.04 R, 87.05, 47.37 R, 47.37 C, DIG. 4, DIG. 6, 642, 643, 644

[56] References Cited

U.S. PATENT DOCUMENTS

| | | | |
|---|---|---|---|
| 2,734,554 | 2/1956 | Ries | 135/67 X |
| 4,007,947 | 2/1977 | Perego | 280/642 |
| 4,025,088 | 5/1977 | Rothschild | 280/644 |
| 4,046,374 | 9/1977 | Breyley | 272/70.3 |
| 4,049,292 | 9/1977 | Perego | 280/642 |
| 4,118,052 | 10/1978 | Cabagnero | 280/642 |
| 4,173,355 | 11/1979 | Perego | 280/642 |
| 4,353,577 | 10/1982 | Giordani | 280/642 |
| 4,369,987 | 1/1983 | Witherell | 280/644 |
| 4,398,748 | 8/1983 | Duvignacq | 280/644 |

*Primary Examiner*—Robert A. Hafer
*Assistant Examiner*—Arnold W. Kramer
*Attorney, Agent, or Firm*—John Holtrichter, Jr.

[57] ABSTRACT

There is herein described an improved light weight walking aid that is readily adjustable, is light weight, and that is easily changed from a securely locked-open configuration to compact folded configuration through novel pivoting and sliding mechanisms wherein the walking aid folds simultaneously in two dimensions.

13 Claims, 5 Drawing Figures

COMPACT FOLDING WALKING AID

TECHNICAL FIELD

This invention relates to the field of portable folding structures, and more particularly to such structures which aid persons who have difficulty walking.

BACKGROUND ART

Light weight structures adapted to aid persons who have difficulty walking by providing a portable platform which can be moved just ahead of the person are well known in the art.

Many of these walking aids are made of an aluminum alloy for its weight saving, but most are rigid structures which are difficult to transport. However, some walking aids have been designed to fold, but these have tended to be bulky. Typically, these designs fold only in one direction and are difficult to transport in a bus, auto, airplane, etc.

In contrast thereto, the invention to be described herein has been designed with unique and advantageous features which obviate the unstable and bulky qualities of prior art structures adapted to help persons walk, while remaining relatively simple to use and construct. It should thus be evident that with these advantageous features, the invention constitutes a significant advancement in the art.

SUMMARY OF THE INVENTION

In view of the foregoing factors and conditions characteristic of the prior art, it is a primary object of the present invention to provide a new and improved compact folding walking aid.

Another object of the present invention is to provide a light weight, stable folding walking aid that utilizes a novel pivoting and sliding mechanisms to allow the folding thereof simultaneously in two dimensions.

Still another object of the present invention is to provide a folding walking aid that is readily adjustable in height and is easily changed from a securely locked-open configuration to a compact folded configuration.

In accordance with an embodiment of the present invention, a compact folding walking aid suitable for supporting persons who have difficulty walking is provided having a pair of parallel elongated frame tubes each with upper, intermediate and lower portions, the frame tubes generally defining a first plane therebetween.

Also included is a pair of parallel side tubes each having upper, intermediate and lower portions, the upper portion of each of the side tubes being pivotally attached at a fixed position along the upper portion of a different one of the frame tubes. The side tubes generally define a second plane therebetween that intersects the first plane at an acute angle, and these tubes also generally define respective parallel third and fourth planes between themselves and associated frame members, which planes are orthogonal to the first and second planes.

Further, the invention includes a front x-brace having a pair of pivotally interconnected front brace members generally defining a fifth plane therebetween, the upper ends of each of the brace members being pivotally attached to a different one of the upper portions of the frame tubes. Also, pivotally attached to the intermediate portions of a different one of the side tubes are rear ends of a pair of side brace members, the length of which primarily determine the maximum amount of the acute angle between the first and second planes. On the other hand, the maximum distance between the third and fourth planes is determined by the extended length of pivotally attached arms of a locking toggle brace, which arms are generally movable in the first plane.

The invention still further includes folding means with an individual guide movably mounted along the intermediate portion of each of the frame tubes, each of these guides being pivotally attached to an associated one of the lower ends of the front brace members, to the front ends of the side brace members and to the outer ends of the toggle arms. This configuration provides for simultaneously causing the decreasing of the acute angle between the first and second planes and lessening of the planar distance between the third and fourth planes when the guides move downwardly along respective frame tubes to a fully folded walking aid position. Likewise, when the guides move upwardly along respective frame tubes to a fully unfolded walking aid position, the acute angle between the first and second planes is increased at the same time the distance between the third and fourth planes is increased.

In accordance with embodiments of the invention, the upper portion of the frame tubes may include handle grips, and a lock/release member may be advantageously attached to the toggle brace at the pivotal interconnection of the arms thereof. Also, adjustably extension members may be attached at the lower end of the frame and side tubes to accommodate users of different height.

The features of the present invention which are believed to be novel are set forth with particularity in the appended claims. The present invention, both as to its organization and manner of operation and use, together with further objects and advantages thereof, may best be understood by making reference to the following description taken in conjunction with the accompanying drawings in which like reference characters refer to like elements in the several views.

DESCRIPTION OF THE PREFERRED EMBODIMENT

Figure 1:
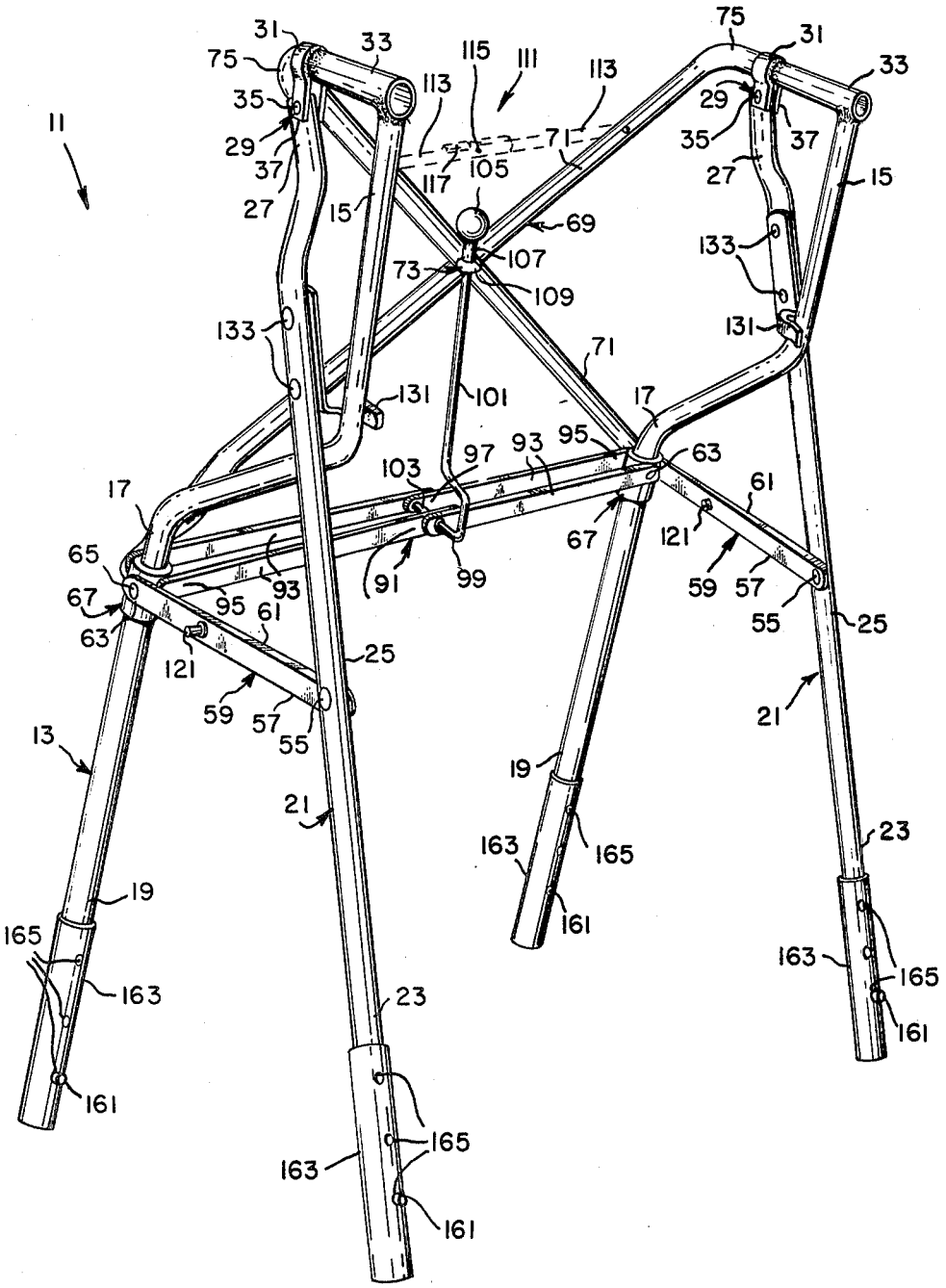
FIG. 1 is a perspective view of a compact folding walking aid in its unfolded or open configuration in accordance with the invention.
Figure 2:
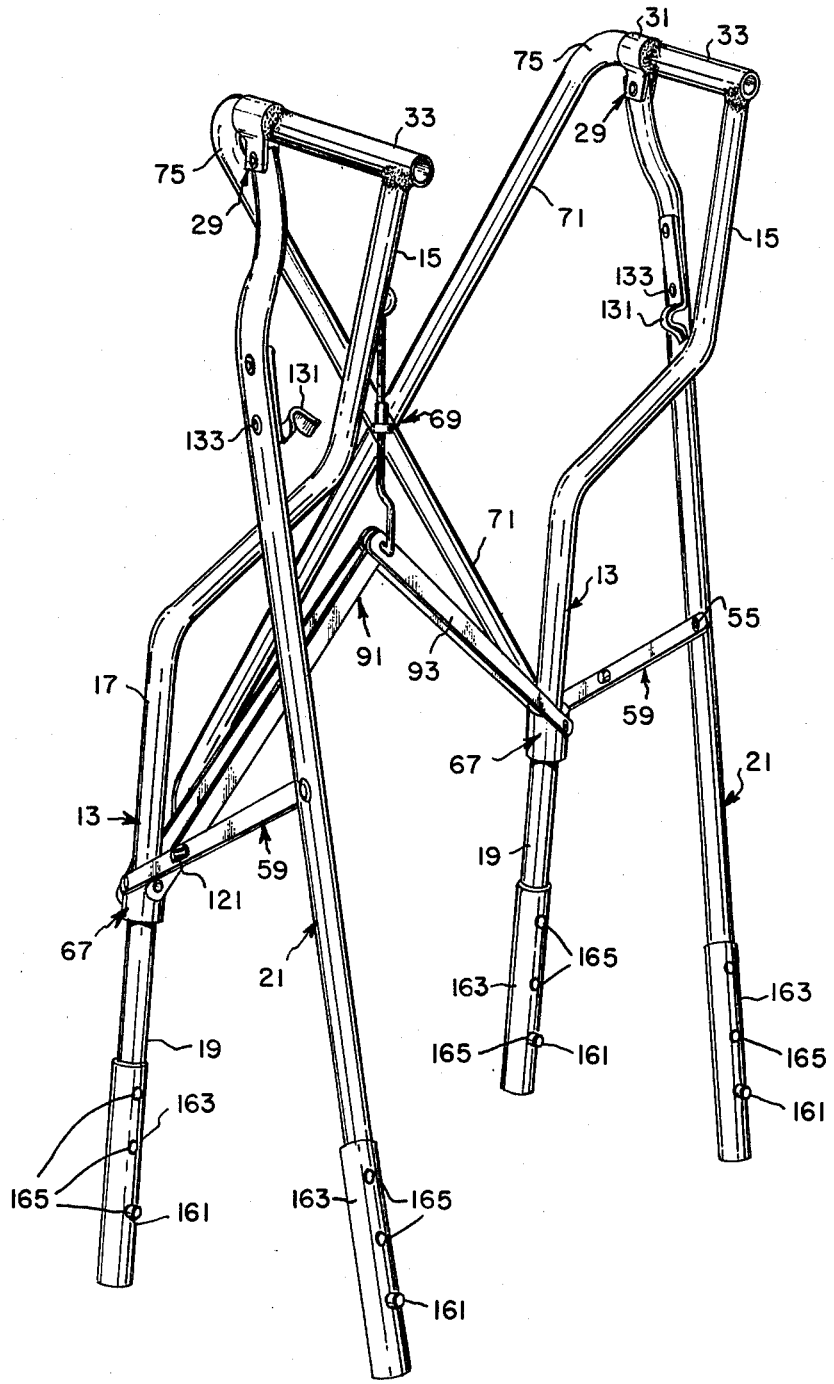
FIG. 2 is a similar view showing the walking aid in a partially folded configuration.

Referring now to the drawings and more particularly to FIGS. 1 and 2, there is shown a compact folding walking aid 11 for supporting persons who have difficulty walking. The walking aid 11 includes a pair of parallel elongated frame tubes 13, each having an upper portion 15, an intermediate portion 17 and a lower portion 19.

A pair of parallel elongated side tubes 21 having lower portions 23 and intermediate portions 25 are respectively attached at their upper portions 27 to the upper portions 15 of the frame tubes 15 by a suitable pivot mechanism 29. The mechanisms 29 may be U-shaped brackets 31 fixedly attached by welding, for example, to horizontal handle sections 33 of the frame tubes' upper portions 15. A bolt 35 extends through a suitable hole in the open end 37 of each bracket 31 and through a hole in the upper portions 27 of associated side tubes 21 enclosed by the brackets.

Pivotally anchored to the intermediate portions 25 of the side tubes 13 by suitable nut and bolt assemblies or rivets 55 are the rear ends 57 of a pair of elongated parallel side brace members 59. Each member has an intermediate portion 61 and a forward end 63 pivotally anchored by a rivet 65 to an outer side of an associated movable guide 67 located generally along the intermediate portion 17 of a frame tube 13.

Figure 3:
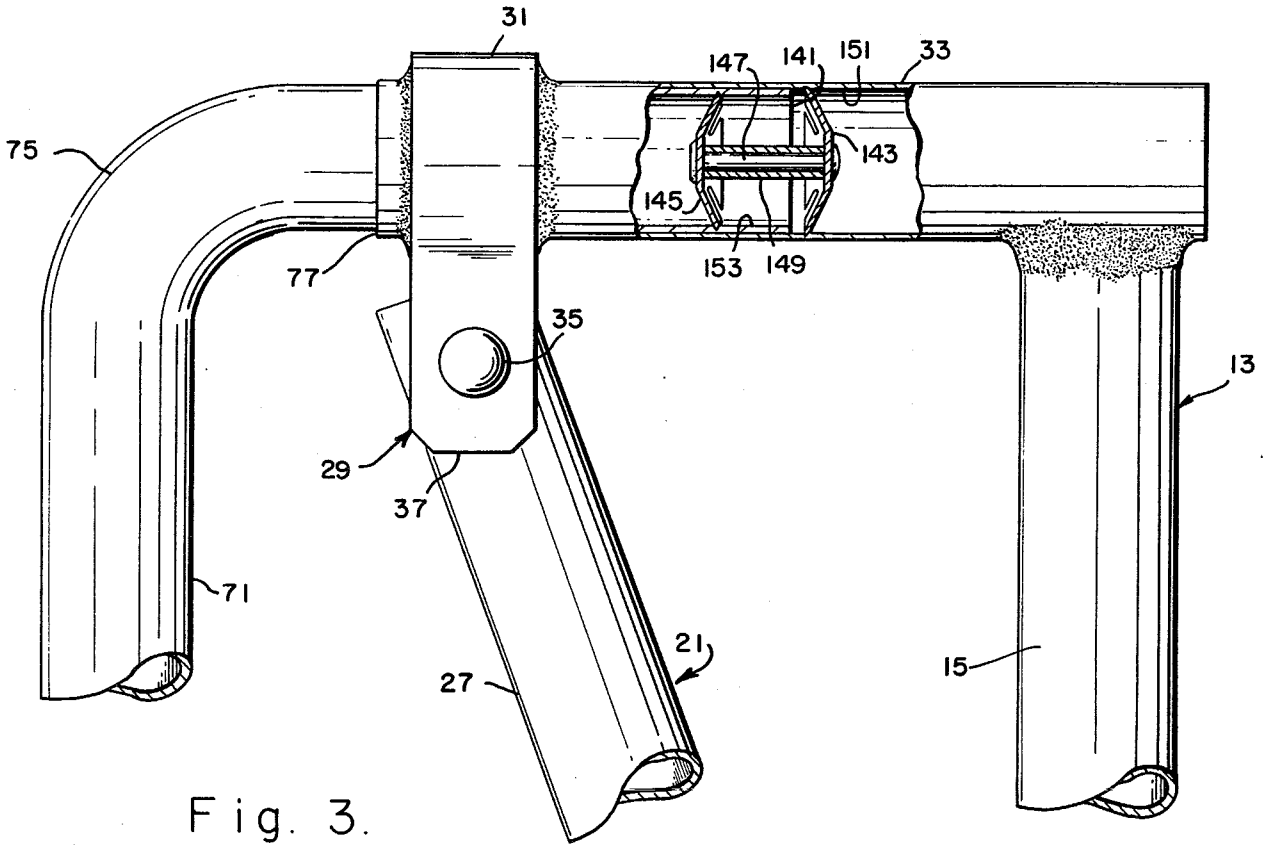
FIG. 3 is an enlarged sectional view of an upper pivot mechanism utilized in the folding walker of FIG. 1.
Figure 4:
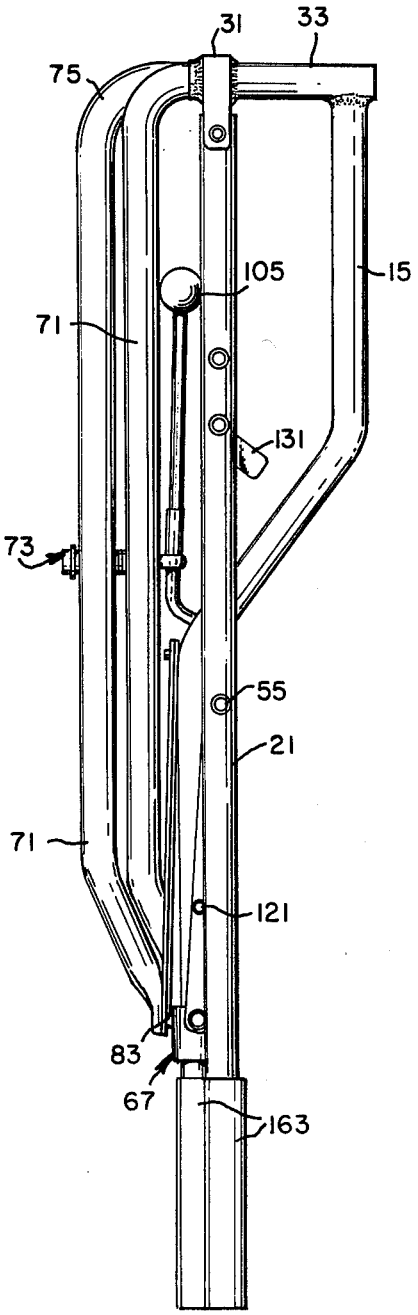
FIGS. 4 and 5 are side and front elevational views, respectively, of the folding walking aid of FIG. 1 in folded condition.

The frame tubes 13 are held in parallel relationship by a front x-brace assembly 69 comprising front brace bar members 71 pivotally interconnected by a pivot 73, while the upper end portions 75 of the brace members are pivotally anchored within the upper ends 77 of the frame tubes 13, as best seen in FIG. 3 and described in more detail later. The lower ends of the members 71 are pivotally anchored to associated front portions of the movable guides 67 by rivet 83, as shown in FIG. 4.

This embodiment of the compact folding walking aid 11 is also provided with a locking toggle brace assembly 91 including a pair of spaced parallel folding arms 93, each pair being pivotally attached at a first of their ends 95 to opposite (front and rear) sides of the movable guides 67, and pivotally attached at their second ends 97 to each other by the lower pivot arm portion 99 of a locking/unlocking bar 101. The arms 93 in each pair may be maintained parallel by the use of a spacer tube 103 coaxially disposed with respect to the arm portion 99, and the pivoting of the arms may be restricted at or below the horizontal by a knob 105 and spacer tube 107 mounted at the upper end of the bar 101 and an eye portion 109 of the pivot 73.

Alternately, in place of the assembly 91, the walking aid 11 may include a simple two-piece pivoting toggle arrangement 111 including arms 113 pivotally interconnected by pivot pin 115 and the other end of each arm pivotally connected to the upper portions respectively of the front brace bar members 71, and shown in dashed outlines in FIG. 1. The arms are prevented from rotating beyond a few degrees below the horizontal by tabs 117 extending over the top of an opposite arm 113.

In this embodiment of the invention, the upper portion 15 of each frame tube 13 is bent generally rearwardly and upwardly in about the upper half of each tube, ending in the horizontal section 33. In this way, the sections 33, which may be separate sections welded in place, are used as handles to bear the weight of the user and are firmly supported by the frame tubes and at the other end by the upper end of the side tubes 21.

In order to collapse or fold the structure 11 from its open configuration shown in FIG. 1, the user merely pulls upwardly on the knob 105 which action moves the arms 93 of the toggle brace assembly 91 upward from a locking position, and allows the frame tubes 13 and the attached side tubes 21 at each side of the structure 11 to be easily moved closer to each other. This sideways collapsing action in turn causes the guides 67 to move downwardly, taking the outer ends 95 of the toggle brace assembly arms, the lower and front ends of the respective x-brace assembly arms 71 and the side brace member arms 59 with them.

Figure 5:
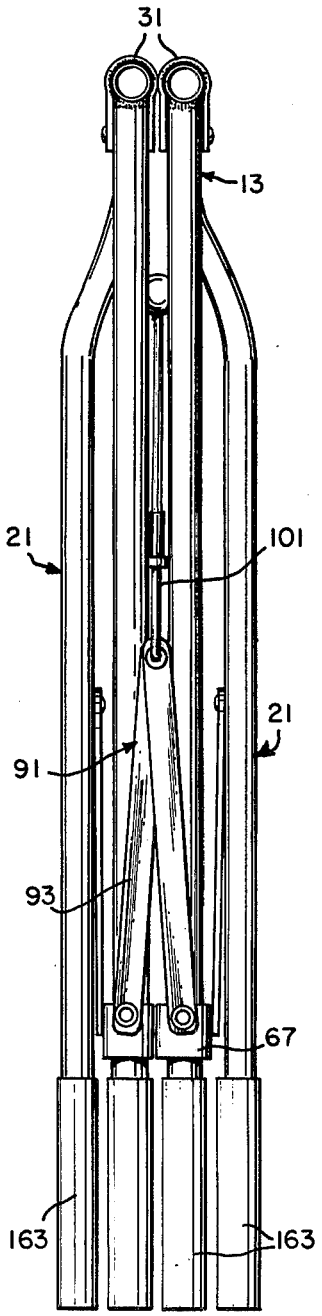

As the side brace member arms pivot downwardly, the side tubes are forced to pivot at the pivot mechanisms 29 and move toward the frame tubes 13, as seen in FIG. 2. This motion can continue until the handle sections 33 contact each other and the structure 11 is in its fully collapsed or closed configuration shown in FIGS. 5 and 6. Thus, the plane defined by the frame tubes 13 and the intersecting plane defined by the side tubes 21 pivot to decrease the angle between these planes. At the same time, the distance between the parallel planes defined by the combination of associated frame tubes 13 and side tubes 21 decreases.

In order to assure that the side brackets 59 cannot rotate to a position parallel to the side tubes 21 and make it difficult to unfold the walking aid 11, a limit pin 121 is provided projecting outwardly from the intermediate portions 61 of the brackets 59.

Preferably, an L-shaped bracket 131 is attached to the upper portion of each of the side tubes 21 by rivets 133 to trap the upper portion 15 of the frame tubes 13 when the walker is moved to its unfolded or open configuration shown in FIG. 1. This insures structure stability when in use to support the weight of its user.

Referring again to FIG. 3, the pivotal anchor located at the junction of the upper end of the brace bar members 71 and the respective upper ends 77 of the frame members 13 is shown in detail. As seen in the broken away section, the open end 141 of each bar member 71 is held in place laterally while still being able to rotate axially by means of a relatively larger diameter outer helix washer 143 rotatably held to a relatively smaller diameter inner helix washer 145 by a rivet 147 and a tubular spacer 149. The outer washer 143 bites into the inner wall 151 of the handle section 33 while the inner washer 145 bites into the inner wall 153 of the bar member 71. Thus, each washer is fixedly anchored to a different member and may rotate with respect to each other through the axial rivet 147.

It should be noted that by providing that the rearwardly extending upper portion of the brace members are pivotally captured within the forwardly extending upper portion of the associated brace members, the folding structure 11 takes on a special shape-retaining integrity without sacrificing collapsibility, compactness or weight considerations.

Since the users of the invention may be of various heights, the distance of the handle sections 33 above the floor may be adjusted by depressing a spring-loaded locating pin 161 in each tube and sliding an associated extension tube 163 either up or down until the pin registers with and protrudes through a desired one of the holes 165 in the tube 163.

Preferably, the various elements of the folding walking aid 11 are fabricated from relatively strong lightweight material such as stainless steel and/or suitable alloys of aluminum, for example, in order to provide a strong but lightweight support.

From the foregoing, it should be quite evident that there has herein been described an improved stable and light-weight folding walking aid. It should also be understood that various materials specified herein are not critical, and any material having suitable characteristics may be utilized. Also, other similarly functioning pivot configurations may be employed.

What is claimed is:

1. A compact folding walking aid for supporting persons who have difficulty walking, comprising:

a pair of parallel elongated frame tubes each having upper, intermediate and lower portions, said frame tubes generally defining a first plane therebetween;

a pair of parallel elongated side tubes each having upper, intermediate and lower portions, said upper portions of each of said side tubes being pivotally attached at a fixed position along said upper portion of a different one of said frame tubes, said side tubes generally defining a second plane therebetween that intersects said first plane at an acute angle, and generally defining respective parallel third and fourth planes between themselves and associated frame members, which planes are orthogonal to said first and second planes;

a front x-brace having a pair of pivotally interconnected front brace members, the upper ends of each of said front brace members being pivotally attached to a different one of said upper portions of said frame tubes;

a pair of side brace members each pivotally attached at their rear ends to said intermediate portion of a different one of said side tubes, the length of said brace members primarily determining the maximum amount of said acute angle;

folding means including an individual guide movably mounted along said intermediate poriton of each of said frame tubes, each of said guides being pivotally attached to an associated one of the respective lower and front ends of said front and side brace members, for simultaneously causing the decreasing of said acute angle between said first and second planes and lessening the distance between said third and fourth planes when said guides move downwardly along respective frame tubes to a fully folded walking aid position, and for simultaneously causing the increasing of said acute angle and the increasing of said distance between said third and fourth planes when said guides move upwardly along respective frame tubes to a fully unfolded walking aid position; and releasable pivoted locking means for maintaining said walking aid in said unfolded walking aid position with all pivotal attached members remaining pivotally attached when the walking aid is fully folded.

2. The compact folding walking aid according to claim 1, wherein said releasable pivoted locking means comprises a frame brace having pivotally attached arms movable generally in the plane of said front x-brace and operatively coupled to said guides, the maximum planar distance between said third and fourth planes being primarily determined by the extended length of said frame brace arms.

3. The compact folding walking aid according to claim 2, wherein the outer ends of said pivotally attached arms of said frame brace are pivotally attached to an associated one of said guides.

4. The compact folding walking aid according to claim 3, wherein said frame brace includes a pair of spaced apart folding arms, the outer ends of said spaced apart folding arms being pivotally attached to opposite sides of an associated one of said guides.

5. The compact folding walking aid according to claim 3, wherein said frame brace also includes a locking mechanism.

6. The compact folding walking aid according to claim 5, wherein said locking mechanism is of the toggle type.

7. The compact folding walking aid according to claim 5, wherein said locking mechanism includes locking/unlocking bar means for temporarily fixing the distance between said third and fourth planes.

8. The compact folding walking aid according to claim 1, wherein said releasable pivoted locking means comprises a frame brace having pivotally attached arms movable generally in the plane of said front x-brace and pivotally attached to different ones of said fromt brace members, the maximum planar distance between said third and fourth planes being primarily determined by the extended length of said frame brace arms.

9. The compact folding walking aid according to claim 8, wherein said frame brace also includes a locking mechanism.

10. The compact folding walking aid according to claim 1, wherein said upper portions of said frame tubes and associated ones of said upper ends of said front brace members have coaxial and overlapping longitudinal dimensions, the diameters of said coaxial structures allowing one structure to slidably fit within an associated structure.

11. The compact folding walking aid according to claim 10, wherein said coaxial structure portions are held in fixed axial relationship by a pivot mechanism.

12. The compact folding walking aid according to claim 11, wherein said pivot mechanism includes a relatively larger diameter helix washer fixedly engaging the inner wall surface of the relatively larger diameter one of said coaxial structure portions, and a relatively smaller diameter helix washer fixedly engaging the inner wall surface of the relatively smaller diameter one of said coaxial structure portions, said two helix washers being operatively coupled together in a fixedly spaced but rotatable relationship.

13. The compact folding walking aid according to claim 1, wherein at least one of said side tubes includes a hook bracket capturing a portion of said frame tube when said walking aid is in said unfolded walking aid position.

* * * * *